United States Patent [19]

Turturro et al.

[11] Patent Number: 4,656,940

[45] Date of Patent: Apr. 14, 1987

[54] METERING ROLL SYSTEM FOR PRINTING PRESS

[75] Inventors: Michael Turturro, Spring Valley; Attilio Rossi, Harrison, both of N.Y.

[73] Assignee: Hantscho, Inc., Mt. Vernon, N.Y.

[21] Appl. No.: 800,735

[22] Filed: Nov. 21, 1985

[51] Int. Cl.[4] ..... B41F 31/06; B41F 31/30

[52] U.S. Cl. ..... 101/350

[58] Field of Search ..... 101/349, 350, 351, 352, 101/DIG. 6, DIG. 10, 148, 207–210

[56] References Cited

U.S. PATENT DOCUMENTS

| | | | |
|---|---|---|---|
| 2,351,612 | 6/1944 | Hawley | 101/349 X |
| 2,795,188 | 6/1957 | Williams | 101/348 |
| 3,455,238 | 7/1969 | Gambella et al. | 101/148 |
| 4,385,559 | 5/1983 | Jarach | 101/352 |

*Primary Examiner*—J. Reed Fisher

*Attorney, Agent, or Firm*—Cobrin & Godsberg

[57] ABSTRACT

A metering roll system for supplying ink to a printing plate, comprises a plurality of rotatable intermediate rolls for supplying ink to the printing plate; a rotatable metering roll for supplying ink to the plurality of intermediate rolls; a rotatable fountain roll for supplying ink to the metering roll; and two bearing rings for providing a constant gap between the fountain roll and the metering roll, the two bearing rings having a diameter greater than that of the metering roll and rotatably mounted at opposite ends of the metering roll and in rolling contact with opposite cylindrical ends of the fountain roll, whereby the gap between the fountain roll and metering roll is maintained constant along the entire length of the metering roll, regardless of eccentricities in rotation of the fountain roll and metering roll.

4 Claims, 4 Drawing Figures

METERING ROLL SYSTEM FOR PRINTING PRESS

BACKGROUND OF THE INVENTION

The present invention relates generally to printing presses and, more particularly, is directed to a metering roll system for a lithographic offset printing press.

Printing presses, such as lithographic offset presses, for printing commercial quality brochures, magazines and the like are well known in the art. For example, a web-fed lithographic offset press sold by Hantscho, Inc. of Mount Vernon, NY under the trademark "MARK 10" is of such type. These presses include a plurality of printing units, each having an ink fountain which provides the color for one of the plates used in the printing operation.

Specifically, a printing press can generally print one or more webs or rolls of paper at one time. For each web to be printed, upper and lower ink fountains are provided which supply ink to respective printing plates. Since only three basic colors, that is, magenta, cyan and yellow, are necessary to produce all other colors, only four different color ink fountains need be provided, black being the fourth color. Since each web is printed on both sides, four plates (and four ink fountains) are provided in series on the upper side of each web, and four plates (and four ink fountains) are provided in series on the lower side of each web. The eight plates constitute a form, that is, the number of plates used to print a signature.

Each ink fountain includes an ink fountain roll associated with one plate, and which supplies ink to the respective plate through a metering roll and a series of intermediate rolls. The intermediate rolls may include, in series, a first distribution roll, a driven distribution roll, a second distribution roll, an ink vibrator roll, and an ink form roll, between the metering roll and the plate to be supplied with ink.

The metering roll, the first distribution roll and the driven distribution roll are rotatably mounted on axles, with the ends of the axles terminating in side brackets. The side brackets, in turn, are pivotally secured to the machine frame at a point just above the axle for the driven distribution roll, whereby the entire assembly of the metering roll, distribution roll and driven distribution roll, can be pivoted by throw-off mechanisms, to move the metering roll away from the fountain roll, for example, when it is desired to run the press in the idle mode with no ink.

It is important that a proper gap be maintained between the fountain roll and metering roll at all times, so that the proper amount of ink is transferred to the plate. In this regard, conventional systems include a paralleling adjustment on the throw-off mechanisms to insure that the metering roll is parallel to the fountain roll. Such systems further include fixed stops associated with the metering roll, and particularly, in contact with the side brackets, to adjust the gap, which may be, for example, 0.003 inches.

In order to set the gap along the entire length of the metering roll, the throw-off mechanisms are turned ON to position the metering roll adjacent the fountain roll. Then, both fixed stops on either side are backed off to permit a paralleling operation. Specifically, the paralleling adjustments on the throw-off mechanisms are adjusted to provide that the metering roll is parallel to the fountain roll and that there is a positive interference or contact of the metering roll with the fountain roll, along the entire length of the metering roll. The two fixed stops are then adjusted to adjust the metering roll and thereby provide a uniform gap of approximately 0.003 inch along the entire length of the metering roll. The stops are then checked to make sure that they are in contact with the side brackets, and that the throw-off mechanisms operates properly.

However, such system requires time consuming and complicated operation set-ups. Further, with such system, after operation for a period of time, further adjustments may be required to insure that the gap is maintained constant. Still further, since the separation between the fountain roll and the metering roll are constant, if there are any eccentricities in the rotations of the fountain roll or metering roll, due to, for example, the respective axles being offset from the central axes thereof, the gap will change, during rotation of the metering roll and fountain roll. This necessarily changes the transfer rate of ink required for the printing process.

OBJECTS AND SUMMARY OF THE INVENTION

Accordingly, it is an object of the present invention to provide a metering roll system for a printing press that provides a constant gap between the fountain roll and metering roll, regardless of any eccentricities in rotation of the fountain roll or metering roll.

It is another object of the present invention to provide a metering roll system for a printing press that eliminates the time consuming and complicated operation for setting the gap between the fountain roll and metering roll in conventional systems.

It is still another object of the present invention to provide a metering roll system for a printing press that does not require any operating adjustments to ensure that the gap between the fountain roll and metering roll is maintained constant.

It is yet another object of the present invention to provide a metering roll system for a printing press that is relatively inexpensive and easy to use and manufacture.

In accordance with an aspect of the present invention, a metering roll system for supplying ink to a printing plate, comprises a plurality of rotatable intermediate rolls for supplying ink to the printing plate; a rotatable metering roll for supplying ink to the plurality of intermediate rolls; a rotatable fountain roll for supplying ink to the metering roll; and ring means for providing a constant gap between the fountain roll and the metering roll, the ring means including two rings having a diameter greater than that of the metering roll and rotatably mounted at opposite ends of the metering roll and in rolling contact with opposite cylindrical ends of the fountain roll.

The above and other, objects, features and advantages of the present invention will become readily apparent from the following detailed description which is to be read in connection with the accompanying drawings.

DETAILED DESCRIPTION OF A PREFERRED EMBODIMENT

Figure 1:
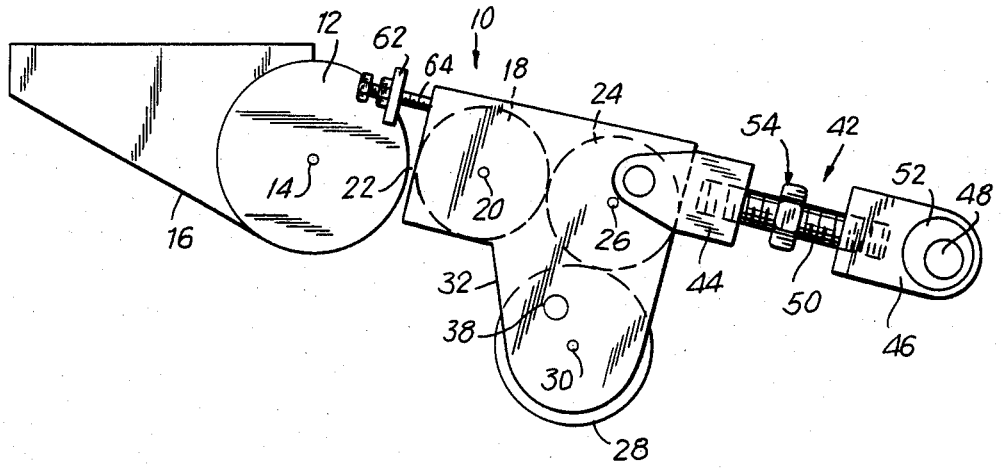
FIG. 1 PRIOR ART
FIG. 1 is a schematic side elevational view of a conventional metering roll system for a printing press.

Referring to the drawings in detail, and initially to FIGS. 1 and 2 thereof, a known metering roll system 10 associated with a steel fountain roll 12 of an ink fountain will first be described. As shown, fountain roll 12 is rotatably mounted on a centrally located axle 14 and is supplied with ink from a reservoir 16.

Metering roll system 10 includes a knurled steel or smooth copper plated metering roll 18 which is rotatably mounted on a centrally located axle 20 and which receives ink from fountain roll 12. Specifically, metering roll 18 is adjusted to be parallel to fountain roll 12 and is separated therefrom by a small gap 22 which is sufficiently small, for example, 0.003 inch, so that the ink can be transferred from fountain roll 12 to metering roll 18 across the gap. The amount of ink that is transferred by fountain roll 12 depends on the gap distance.

A rubber covered distribution roll 24 is rotatably mounted on a centrally located axle 26, in rolling contact with metering roll 18. Distribution roll 24 is adjusted for the proper amount of pressure with respect to metering roll 18, and is thereby supplied with ink from metering roll 18.

A driven distribution roll 28 is rotatably mounted on a centrally located axle 30, in rolling contact with distribution roll 24. Distribution roll 24 is also adjusted for the proper amount of pressure with respect to driven distribution roll 28, and thereby supplies ink to driven distribution roll 28.

Driven roll 24 and driven distribution roll 28, in combination with other rolls (not shown), such as another distribution roll, an ink vibration roll and an ink form roll, constitute intermediate rolls which are in rolling contact with each other for supplying ink to the respective plate.

Axles 20, 26 and 30 have their free ends mounted in opposite side brackets 32 and 34 which, in turn, are pivotally mounted to the machine frame 36 by pivot shafts 38 and 40. As shown in FIG. 1, the pivot points for pivot shafts 38 and 40 are slightly above the mounting of axle 30 for driven distribution roll 28.

Metering roll system 10 further includes a throw-off mechanism 42 on the operator side and drive side of the system. Specifically, each throw-off mechanism 42 includes a first linkage bracket 44 pivotally secured to an upper rear portion of the respective side bracket 32 or 34, a second linkage bracket 46 rotatably mounted on a circular cross bar 48 secured across machine frame 36 between the operator and drive sides, and a threaded bar 50 screw threadedly received within first and second linkage brackets 44 and 46. As shown in FIG. 1, an eccentric member 52 is secured around cross bar 48 on each side of the system, and second linkage brackets 46 are rotatably mounted on eccentric members 52. As a result, when cross bar 48 is rotated in the clockwise direction of FIG. 1, eccentric members 52 move second linkage brackets 46, and thereby the entire throw-off mechanisms 42, to the right, whereby metering roll 18 is moved away from fountain roll 12.

A hexagon shaped nut-like member 54 is formed integral with, or secured to, threaded bar 50, whereby threaded bar 50 can be turned to adjust the distance of each side of metering roll 18 with respect to fountain roll 12, so as to provide that metering roll 18 is parallel to fountain roll 12. In this manner, a paralleling adjustment is achieved.

In addition, two stops 58 and 60 are provided on opposite sides of the system to adjust gap 22 to a desired distance. Each stop includes an L-shaped bracket 62 secured to machine frame 36, each L-shaped bracket 62 having a screw-threaded aperture (not shown) through which a bolt 64 is screw-threadedly received, and which abuts against the forward edge of the respective side bracket 32 or 34, as shown in FIG. 2, to adjust gap 22. Thus, by turning bolts 64, the gap distance between fountain roll 12 and metering roll 18 can be changed.

Figure 2:
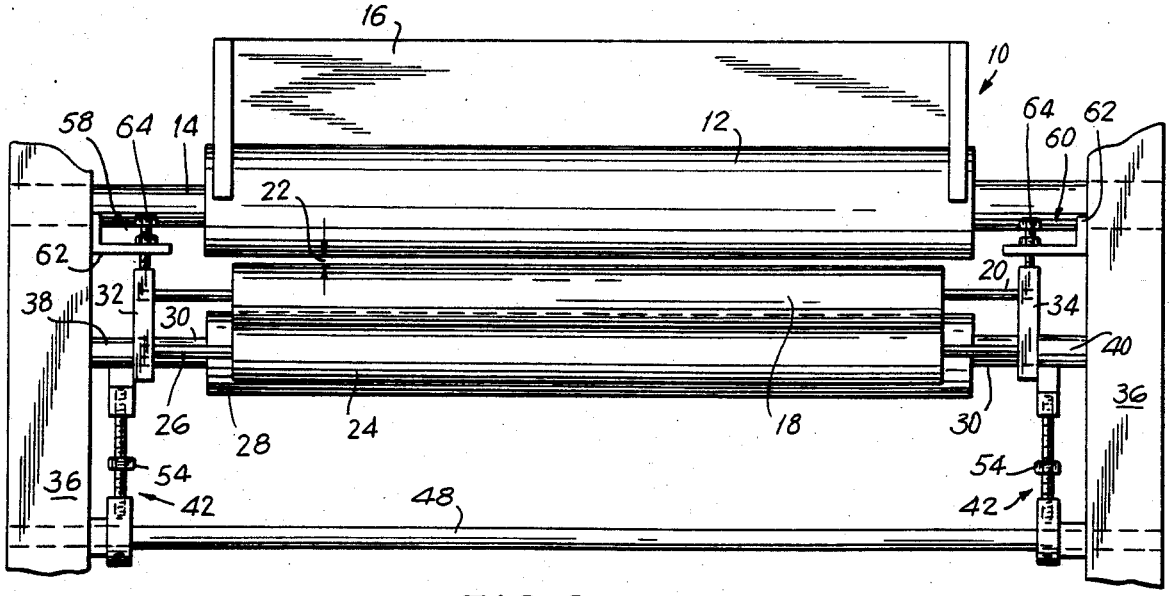
FIG. 2 PRIOR ART
FIG. 2 is a schematic top plan view of the metering roll system of FIG. 1, secured to a machine frame.

In order to set the gap along the entire length of the metering roll, throw-off mechanisms 42 are turned ON to position metering roll 18 adjacent fountain roll 12, that is, cross bar 52 is rotated so that eccentric members 52 are moved to the position shown in FIG. 1. Then, both fixed stops 58 and 60 on either side are backed off to permit a parelleling operation. Specifically, the two threaded bars 50 on throw-off mechanisms 42 are adjusted to provide that metering roll 18 is parallel to fountain roll 12 and that there is a positive interference or contact of metering roll 18 with fountain roll 12 along the entire length of metering roll 18. The two fixed stops 58 and 60 are then adjusted to adjust the gap distance between metering roll 18 and fountain roll 12, and thereby provide a uniform gap of approximately 0.003 inch along the entire length of metering roll 18. Stops 58 and 60 are then checked to make sure that they are in contact with side brackets 32 and 34, and that throw-off mechanisms 42 operate properly.

However, such system requires time consuming and complicated operation set-ups. Further, with such system, after operation for a period of time, further adjustments may be required to insure that gap 22 is maintained constant. Still further, since the separation between fountain roll 12 and metering roll 18 is constant, if there are any eccentricities in the rotations of fountain roll 12 or metering roll 18, due to, for example, the respective axles being offset from the central axes thereof, the gap distance will change. This necessarily changes the transfer rate of ink required for the printing process, which is disadvantageous.

Figure 3:
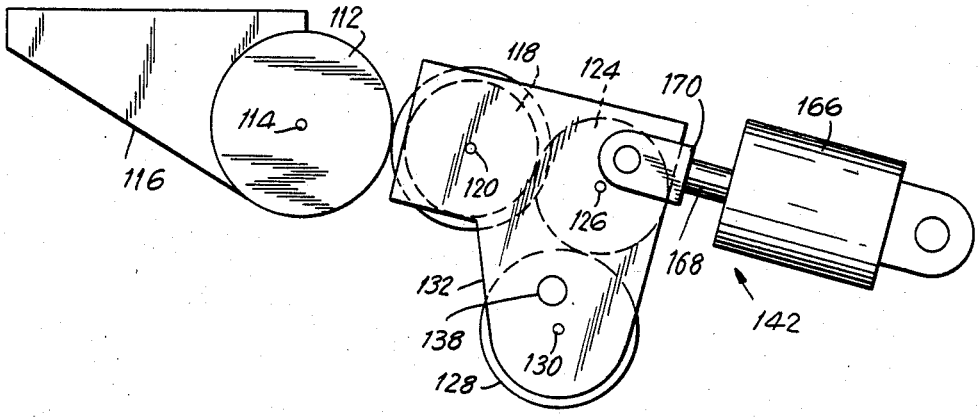
FIG. 3 is a schematic side elevational view of a metering roll system for a printing press according to the present invention.
Figure 4:
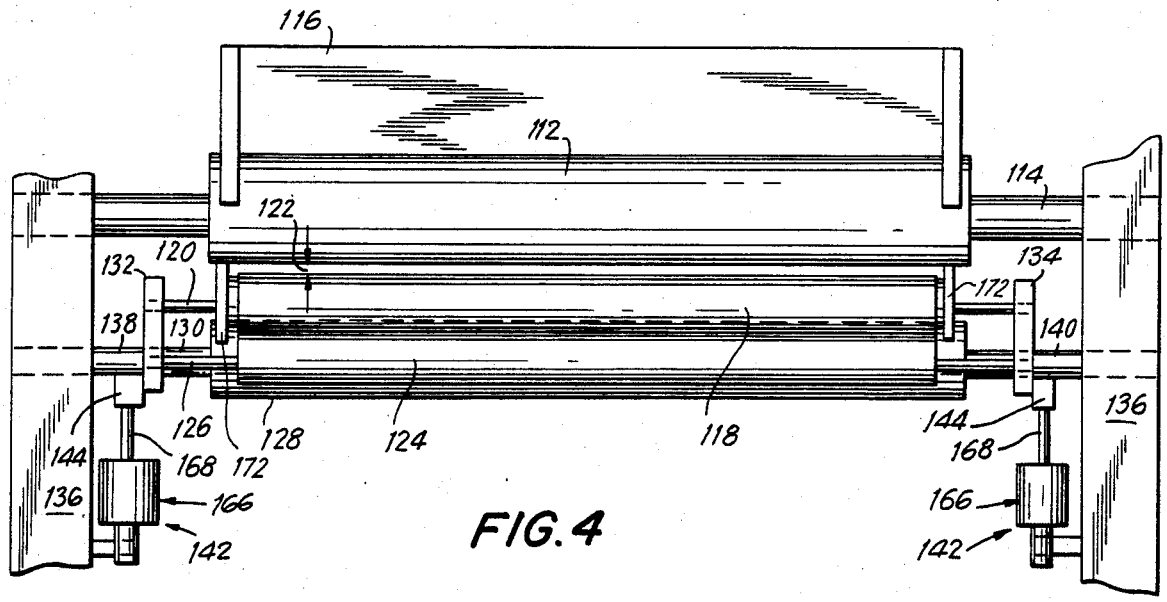
FIG. 4 is a schematic top plan view of the metering roll system of FIG. 3, secured to a machine frame.

Referring now to FIGS. 3 and 4, a metering roll system 110 according to the present invention will now be described, in which like elements are represented by the same numerals, augmented by 100, and a detailed description of such like elements will be omitted for the sake of brevity.

Specifically, stops 58 and 60 of conventional metering roll system 10 are eliminated in metering roll system 110 according to the present invention. Further, threaded bars 50 and eccentric members 52 are also eliminated, although throw-off mechanisms 142 are retained, although in different form.

Throw-off mechanisms 142 are each comprised of an air cylinder 166 on opposite sides of the system, pivotally secured to frame 136. Each air cylinder 166 includes a reciprocable piston 168, and a linkage bracket 144 secured to the free end of each piston 168 and which is pivotally secured to an upper rear portion of the respective side bracket 132 or 134. In this manner, metering roll 118 can be moved away from fountain roll 112, merely by retracting piston 168.

In accordance with the present invention, two bearing rings 172 are secured to opposite ends of metering roll 118, and thereby rotate with metering roll 118. Bearing rings 172 have a larger diameter than metering roll 118 by, for example, 0.006 inch, and are in rolling contact with opposite cylindrical ends of fountain roll 112. Thus, gap 122 is maintained constant by bearing rings 172, regardless of any eccentricities in rotation of fountain roll 112 or metering roll 118. For example, as metering roll 118 and fountain roll 112 rotate, if there are any eccentricities in the rotation of fountain roll 112, bearing rings 172 which ride on fountain roll 112, will cause metering roll 118 to rotate with such eccentricities in rotation, and thereby the gap will remain constant. In like manner, if there is any eccentric rotation of metering roll 118, since bearing rings 172 are secured to the ends of metering roll 118, again bearing rings 172 will ride on fountain roll 112 at all times so that the gap 122 is maintained constant, regardless of such eccentric rotations. As a result, there is always uniformity in the transfer rate of ink. In addition, there is no need for time consuming and complicated operational set-ups.

Having described a specific preferred embodiment of the invention with reference to the accompanying drawings, it will be appreciated that the present invention is not limited to that specific embodiment, and that various changes and modifications may be effected therein by one of ordinary skill in the art, without departing from the scope and spirit of the invention as defined by the appended claims.

What is claimed is:

1. A printing system ink metering apparatus comprising an ink reservoir having an interior into which ink is placed, a fountain roll, said fountain roll including an exterior cylindrical surface, a portion of said fountain roll exterior cylindrical surface being immersed in ink that is located in said ink reservoir, said fountain roll including an axis about which said fountain roll rotates, a metering roll having an exterior cylindrical surface, said metering roll including an axis about which it rotates, said metering roll axis and said fountain roll axis being parallel to each other, said metering roll exterior cylindrical surface being spaced from said fountain roll exterior cylindrical surface, ring means mounted on said metering roll exterior cylindrical surface and having a diameter greater than that of said metering roll exterior cylindrical surface, said ring means mounted at opposite ends of said metering roll exterior cylindrical surface and rotatable relative to said metering roll exterior cylindrical surface, said ring means being in rolling contact with opposite ends of said fountain roll exterior cylindrical surface with said ring means by being rotatably mounted on said metering roll allowing said metering roll exterior cylindrical surface to have a different tangential velocity than that of fountain roll exterior cylindrical surface.

2. A printing ink metering apparatus according to claim 1 where in said ring means is comprised of at least one bearing ring.

3. A printing ink metering apparatus according to claim 1 wherein said ring means is comprised of bearing rings having a diameter greater than that of said metering roll exterior cylindrical surface by approximately 0.006 inch.

4. A printing ink metering apparatus according to claim 1 including means for allowing said fountain roll to be moved toward and away from said metering roll, including means for allowing said metering roll to be moved toward and away from said fountain roll.

* * * * *